United States Patent [19]

Freyn

[11] 4,216,746

[45] Aug. 12, 1980

[54] CYLINDER HEAD FOR AN AIR-COOLED INTERNAL COMBUSTION ENGINE

[75] Inventor: Fritz Freyn, Graz, Austria

[73] Assignee: Hans List, Graz, Austria

[21] Appl. No.: 911,535

[22] Filed: Jun. 1, 1978

[30] Foreign Application Priority Data

Jun. 7, 1977 [AT] Austria ..... 4032/77

[51] Int. Cl.[2] ..... F02S 1/32

[52] U.S. Cl. ..... 123/41.69; 123/41.7

[58] Field of Search ..... 123/41.6, 41.65, 41.67, 123/41.68, 41.69, 41.7

[56] References Cited

U.S. PATENT DOCUMENTS

| | | | |
|---|---|---|---|
| 2,199,619 | 5/1940 | Daub | 123/41.69 |
| 2,270,990 | 1/1942 | Bachle | 123/41.69 |
| 2,691,366 | 10/1954 | Flatz et al. | 123/41.69 |
| 2,725,045 | 11/1955 | Flatz et al. | 123/41.69 |
| 2,753,853 | 7/1956 | Hands | 123/41.67 |
| 2,758,580 | 8/1956 | Balzer | 123/41.67 |
| 2,887,994 | 5/1959 | Morris | 123/41.69 |
| 2,985,155 | 5/1961 | Hockel | 123/41.69 |
| 3,120,840 | 2/1964 | Hatz | 123/41.67 |
| 3,316,888 | 5/1967 | Bachle | 123/41.69 |
| 3,650,250 | 3/1972 | Lohr et al. | 123/41.69 |

*Primary Examiner*—Ronald H. Lazarus

*Attorney, Agent, or Firm*—Watson, Cole, Grindle & Watson

[57] ABSTRACT

A cylinder head for an air-cooled internal combustion engine having its intake and its exhaust ducts each arranged transversely to the direction of cooling air flow and having groups of cooling fins arranged vertically and perpendicularly with respect to the cylinder axis and air leading surfaces. The groups of cooling fins and the air-leading surfaces are located with respect to each other such that the cooling air is split into a number of partial cooling air streams, thus enabling controlled cooling of the entire cylinder head and a uniform temperature distribution in the cylinder head.

5 Claims, 6 Drawing Figures

CYLINDER HEAD FOR AN AIR-COOLED INTERNAL COMBUSTION ENGINE

BACKGROUND OF THE INVENTION

1. Field of the Invention

The invention relates to a cylinder head for an air-cooled internal combustion engine having its intake duct and its exhaust duct each arranged transversely to the direction of cooling air flow and having groups of cooling fins arranged perpendicularly and parallel with regard to the cylinder axis, the cylinder head also including air-leading surfaces, and the lower region of the cylinder head below the intake and the exhaust ducts being provided with cooling fins oriented perpendicularly to the cylinder axis and extending from the front to the backside of the cylinder head in the direction of the air flow, the upper region of the cylinder head between the valve guides including a group of cooling fins arranged to extend parallel to the cylinder axis, at the height of the intake and the exhaust ducts on the sides of the afflux of cooling air and on both sides of the cooling fins oriented to extend parallel to the cylinder axis there being further provided a group of cooling fins oriented perpendicularly with respect to the cylinder axis and extending to the walls of the intake and exhaust ducts respectively, and at the exit for the cooling air there being arranged a group of cooling fins oriented to extend parallel to the cylinder axis, and on the side of the afflux of cooling air there being provided air-leading surfaces, these air-leading surfaces forming outlets on the sides of the cylinder head for a part of the cooling air, and above the cylinder head these being arranged a further air-leading surface extending over the cooling fins located with respect to the direction of the cooling air flow in front and behind the intake and the exhaust ducts.

2. Description of the Prior Art

With known embodiments of the kind described above the intake and the exhaust duct are each arranged to extend transversely to the crankshaft axis for various reasons, and primarily due to construction limitations. Cooling air is supplied by a flywheel blower and is blown in a direction parallel to the crankshaft axis over the cylinder head. Due to the arrangement of the intake and the exhaust ducts, these structures will constitute an obstacle for the cooling air so that the parts of the cylinder head lying lee of the ducts are not cooled in a satisfactory fashion. In addition, the cooling air reaching the backside of the cylinder head will be already heated up, and as a consequence, the parts of the cylinder head in the region of the exit for the cooling air will less effectively cooled. Engines of the kind referred to are often subject to cooling problems of their cylinder heads.

Certain improvements in these conditions can be gained with a construction of a cylinder head published in DE-OS No. 1930 148. The cylinder head described in this German document has at the height of the intake and the exhaust ducts on the sides of the afflux of cooling air, a group of cooling fins oriented to extend parallel to the cylinder axis, and on both sides of each group a further group of cooling fins is arranged to extend perpendicularly to the cylinder axis, the cooling fins respectively extending to the walls of the intake and the exhaust ducts. At the exit for the cooling air a further group of cooling fins is provided which extend parallel to the cylinder axis, and on the side of the afflux of cooling air, air-leading surfaces are arranged which form outlets on the sides of the cylinder head for a part of the cooling air, which outlets are located in front of the walls of the intake and the exhaust ducts. Above the cylinder head a further air-leading surface is provided which extends over the cooling fins located with respect to the direction of the cooling air flow in front and behind the intake and the exhaust ducts and which air-leading surface is cast integrally with the cooling fins.

This construction is afflicted with the essential disadvantage that due to the integral casting of the cylinder head and the thereabove-arranged air-leading surface, production of the cylinder head is more difficult. Because of the relatively large cooling air conduits in the region of the cooling air exit and because of the lack of lateral air leading surfaces behind the intake and the exhaust ducts, cooling of this part of the cylinder head is unsatisfactory.

SUMMARY OF THE INVENTION

It is the aim of the present invention to modify the basic construction of the known designs to avoid the above-mentioned disadvantages and to propose a solution which enables simultaneously good cooling conditions and easy production of the cylinder head.

According to the invention a cylinder head of the kind referred to at the beginning has an air-leading surface above the cylinder head which forms in the frontal region of the cylinder head, and together with the topmost portions of the cooling fins of both the groups of lateral cooling fins extending perpendicularly with respect to they cylinder axis, an air duct by keeping a distance between the air-leading surface and, i.e., the topmost portions of the fins, the air duct extending between the valve guides and over the intake and the exhaust ducts, and changing over in the backside range of the cylinder head to a number of air conduits, these air conduits being formed by the group of cooling fins arranged to extend parallel to the cylinder axis on the backside of the cylinder head and the air-leading surface above the cylinder head, this surface providing here at most a small distance, the air-leading surfaces on the sides of the cylinder head extending to the backside of the cylinder head and forming there an outlet for the cooling air.

This arrangement enables a controlled leading of cooling air streams so that on the whole cylinder head cooling conditions of essentially better uniformity are gained. Therefore, the amount of cooling air and power input of the blower can be reduced. Besides this, deformations of the cylinder and the cylinder head due to thermal stress are avoided because of the good thermocentric cooling. This results in less wear and longer durability of the engine. The provision of the lateral cooling air outlets in front of the impeding walls of the inlet and the exhaust ducts allows egress of a part of the already heated cooling air, and because of the transfer of cooling air over the intake and the exhaust ducts, the ducts themselves and also the backside portions of the cylinder head are cooled well. Due to the air-leading surface provided in the region of the valve guides and the backside of the cylinder head very near to the cooling fins, and due to the lateral air-leading surface which extend to the backside of the cylinder head, cooling air flow is accelerated in this normally (with respect to cooling) critical region, and a significantly better heat transmission results. A further advantage of the invention is the possibility of easy casting of the cylinder head whereby the three straight pulling directions i.e., to both sides and upwards for removal of the cores, accommodate the production.

According to the invention the lateral outlets for a part of the cooling air are provided within the air-leading surfaces on both sides of the cylinder head and form throttling points for the emerging cooling air. Fabrication of these outlets is simple and they can be adapted easily to the cooling requirements.

According to an advantageous modification of the invention the cross-sectional area of the lateral outlets is variable, for instance by means of sliders, in dependence upon an operational parameter of the engine, preferably the temperature of the emerging cooling air. This enables a simple and reliable control of the cooling air flow, being especially advantageous when the engine is operated not only at one single rotational speed but at various speeds. By this arrangement excessive and also insufficient cooling, both being disadvantageous with respect to fuel consumption and operational reliability, is avoided.

According to a further arrangement of the invention the air-leading surface above the cylinder head may be secured to the latter together with the rocker arm bearing blocks by means of the bolts provided for the mounting of the bearing blocks, the air-leading surface having a recess in the region of the valve guides and the rocker arms, and forming together with a cover and a gasket a tightly closed rocker box. The simultaneous use of the air-leading surface above the cylinder head as a leading surface and as lower part of the indispensable rocker box makes the construction simpler and cheaper. Utilization of the mounting elements for the rocker arm bearing blocks for securing the air-leading surface at the cylinder head enables a further simplification and cheapening, both during production and of the engine assembly.

In a further embodiment of the invention of cooling fins may be positioned on the intake and the exhaust duct in the region of the air conduits passing over the ducts. Because of the better heat transmission achieved at this normally significantly hotter region as compared with the rest of the cylinder head, a more uniform temperature distribution in the cylinder head results.

DESCRIPTION OF THE DRAWINGS

The invention will be hereinafter more specifically explained with reference to an exemplary embodiment depicted in the accompanying drawings, wherein.

DESCRIPTION OF THE PREFERRED EMBODIMENT

Figure 3:
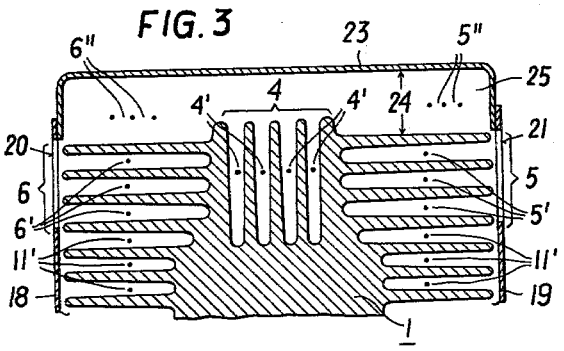
FIG. 3 is a vertical sectional view taken along line III—III in FIG. 1.
Figure 1:
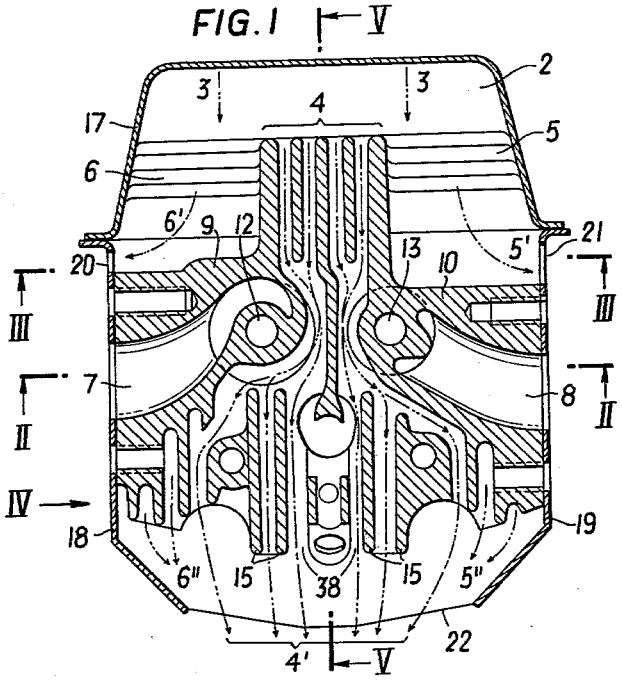
FIG. 1 is a horizontal sectional view of the cylinder head taken along line I—I in FIG. 2.
Figure 4:
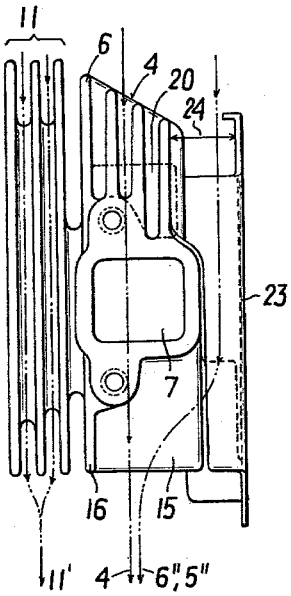
FIG. 4 is a side view as seen along arrow IV in FIG. 1.
Figure 2:
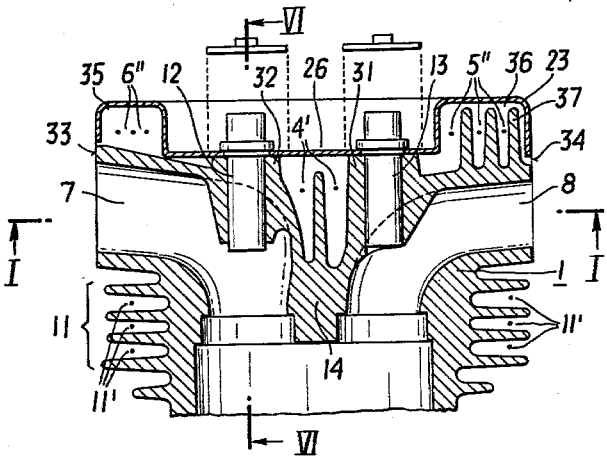
FIG. 2 is a vertical sectional view taken along line II—II in FIG. 1.
Figure 5:
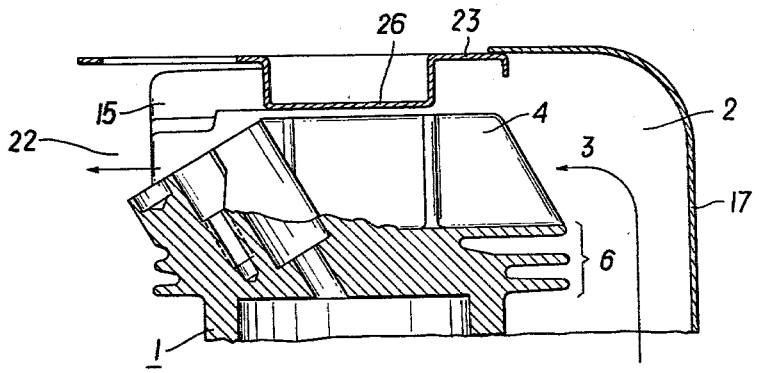
FIG. 5 is a vertical sectional view taken along line V—V in FIG. 1.
Figure 6:
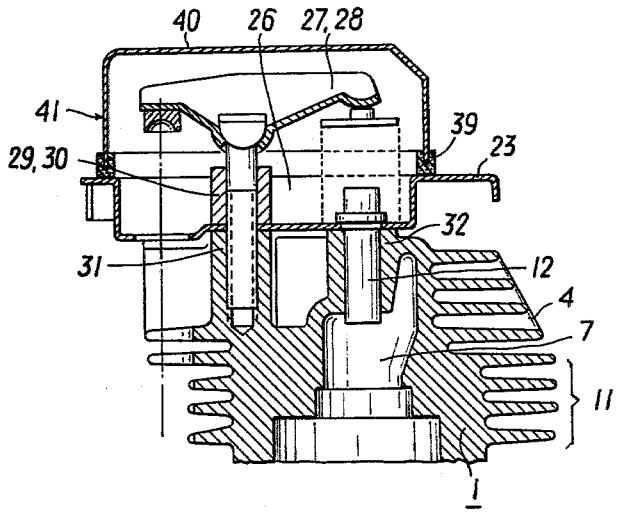
FIG. 6 is a sectional view taken along line VI—VI in FIG. 2.

In the following description the terms "in front" and "at the back", or "front part", and "rear part" respectively, are indications of position with regard to the direction of cooling air flowing past the cylinder head.

On the front part of the cylinder head 1 a group of cooling fins 4 is arranged to extend in a direction parallel to the cylinder axis so as to be positioned in the plane of symmetry and of the cylinder head on opposite sides of the cylinder head a group of cooling fins 5,6 is respectively arranged to extend perpendicularly to the cylinder axis. These groups of fins 5,6 extend to the respective walls 9 and 10 of the intake duct 7 and the exhaust duct 8. The outermost fins of the group of cooling fins 4 axis are strenghthened downwardly to the bottom of the cylinder head so as to improve heat flow from the bottom of the cylinder head to the group of cooling fins 5,6, respectively.

In the lower region of the cylinder head 1 a further group of cooling fins 11 is provided to extend perpendicularly to the cylinder axis, which fins 11 surround the cylinder head without interruption. The group of cooling fins 4 extends into the vicinity of the valve guides 12,13. If there is a sufficiently large gap between the valve guides, one cooling fin may be designed so as to extend through the gap and over the valve web 14 to the rear part of the cylinder head 1.

At the rear part of the cylinder head 1 a further group of cooling fins 15 is provided to extend parallel to the cylinder axis at the upper region of the cylinder head 1 and along the height of the intake duct 7 and exhaust duct 8. This group of fins 15 extends to a single cooling fin 16 arranged in the lower part of the cylinder head beginning at the intake and the exhaust ducts. The middle front part of the upmost fin of the group of cooling fins 11 and the single cooling fin 16 are also strenghthened towards their bases in order to create better heat transfer to the groups of cooling fins 4 and 5.

The cylinder head 1 is enclosed by air-leading surfaces which are designed in the described embodiment as sheet metal guides. The air-leading surface 17 at the afflux of cooling air is at the frontal side of the cylinder head 1, spaced away from the groups of cooling fins 4, 5, 6 but on both sides of the cylinder head is closely fitted to the groups, of cooling fins 5, 6, 11. The leading surface 17 is laterally set forth by lateral air-leading surfaces 18, 19 which have along the height of the intake and the exhaust duct 7,8 and in front of these ducts outlet openings 20, 21 forming throttling points for the emerging cooling air. The air-leading surfaces 18, 19 extend to the rear side of the cylinder head 1 and there they are bent towards each other, but so as to leave an outlet opening 22 for the cooling air which is spaced a distance past the groups of cooling fins 1, 15.

Above the cylinder head 1 is arranged a further air-leading surface 23 which, together with the air-leading surfaces 17, 18, 19 encloses the cylinder head 1. The air-leading surface 23 extends over the groups of cooling fins 4, 5, 6, 15 which are arranged in front and behind the intake and the exhaust ducts, and forms at the front part of the cylinder head 1, an air duct 25 due to the creation of a spacing 24 between it and the uppermost portions of the fins in groups of 5 and 6. In the region of the valve guides 12, 13 and the rocker arms 27, 28, the air-leading surface 23 has a recess 26, and it lies there on coupons 31, 32 provided on the cylinder head 1 for the rocker arm bearing blocks 29, 30 and the valve guides 12, 13. The air-leading surface 23 is secured to the cylinder head 1 together with the rocker arm bearing blocks 29, 30 by means of bolts (not shown) used for the mounting of the bearing blocks.

In the region of the intake and the exhaust ducts 7, 8, in the vicinity of the plane surfaces 33, 34 for the connection of the intake and the exhaust pipes, the original height of the air leading surface 23 is maintained in order to form air passages 35, 36 which pass over the intake duct 7 and the exhaust duct 8, respectively. On both ducts 7, 8, and preferably on the exhaust duct 8, there may be provided cooling fins 37. At the rear part of the cylinder head 1 the air-leading surface 23 is, in the region of its recess 26, not spaced or only slightly spaced away from the group of fins 15 so that the air duct 25 is divided into a number of air conduits 38 corresponding to the number of cooling fins extending parallel to the cylinder axis. In the rear end of the cylinder head 1 the rim of the air-leading surface 23 is designed as to have its original height, thus forming a trough-like structure with the all around rim lying in a plane surface. On this rim a cover 40 is positioned using a suitable gasket 39. The cover 40 is secured to the air-leading surface 23 in a suitable manner (not shown), thus forming together with the trough-like structure of the air-leading surface 23 a tightly closed rocker box 41.

With the aid of the described arrangement of groups of cooling fins and air-leading surfaces, cooling of the cylinder head is achieved in the following way:

The cylinder head 1 has a stream of cooling air directed there against which is delivered over an air well and which is supplied by a blower which, for single cylinder engines, is preferably generated by a flywheel blower. The air stream, indicated by arrow 3, is divided into a number of partial air streams 4', 5', 6' and 11' by means of the groups of cooling fins 4, 5, 6 and 11. The air stream 11' is conducted by the group of cooling fins 11 and the lateral air leading surfaces 18, 19 at the lower part of the cylinder head 1 to the rear of the latter, whereby the lower part of the cylinder head is cooled. The air streams 5' and 6' are deflected by the walls 9, 10 of intake and the exhaust ducts 7, 8 to the sides of the cylinder head, and having been heated, exit through the outlet openings 20, 21 provided in the lateral air leading surfaces 18, 19. From the air stream 5', 6' partial streams 5'', 6'' are split off which flow above the upmost cooling fins of the groups of fins 5, 6 and over the air conduits 35, 36 to the rear of the cylinder head, thereby cooling the intake and exhaust ducts 7, 8. Subsequently, the partial air streams are directed downwardly by the air-leading surface 23 and the group of cooling fins 15, thus cooling the lateral regions of the rear of the cylinder head, the heated air finally emerging through the exit 22. The air stream 4', formed by the group of cooling fins 4 extending parallel to the cylinder axis and by the air leading surface 23, cools the upper region of the cylinder head 1, passes through between the valve guides 12, 13 with increasing velocity and with an intensified cooling effect, and flows—conducted by the air-leading surface 23 and the group of cooling fins 15 extending parallel to the cylinder axis—downwardly to the rear middle part of the cylinder head 1, and finally emerges through the exit opening 22 to the surroundings.

I claim:

1. In a cylinder head for an air-cooled internal combustion engine which comprises:

an intake duct and an exhaust duct, each said duct being positioned to extend transversely to the direction of cooling air flow around said cylinder head, valve guides, groups of cooling fins oriented both parallel with the cylinder axis in said cylinder head and perpendicularly with respect thereto, lateral and top air-leading surfaces, the improvement wherein:

a first group of said groups of cooling fins is positioned in a region below said intake and exhaust ducts are oriented so as to extend perpendicularly with respect to the cylinder axis and from the frontside to the backside of the cylinder head, as seen in the direction of cooling air flow, a second group of said groups of cooling fins is positioned in a region between said valve guides and oriented to extend parallel with respect to the cylinder axis, a third group of said groups of cooling fins is positioned on both sides of said second group of cooling fins in the region of said intake and exhaust ducts and on the side of the afflux of cooling air, said third group of cooling fins extending perpendicularly to the cylinder axis and also extending to the walls of the intake and exhaust ducts, respectively, a fourth group of said groups of cooling fins is positioned at the exit of the cooling air and to extend parallel with respect to the cylinder axis, said lateral air-leading surfaces is located on the side of the afflux of cooling air, said surfaces including lateral outlets for a part of the cooling air on both sides of the cylinder head, said top air leading surface is positioned above the cylinder head in spaced relation to the topmost portions of the fins in said third group of cooling fins so as to form an air duct in front of said intake and exhaust ducts, seen in the direction of cooling air flow, said fourth group of cooling fins forming together with said top air-leading surface a number of air conduits behind said intake and exhaust ducts, an air duct extending between said valve guides and above said intake and exhaust ducts merging with said air conduits, said top air-leading surface having in the region of said air conduits no more than a small distance between it and said fourth group of cooling fins, and said lateral air-leading surfaces extending to the backside of the cylinder head where they form an outlet for cooling air.

2. The cylinder head of claim 1 wherein said lateral outlets in said lateral air-leading surfaces are respectively provided immediately on the frontside of the walls forming said intake and exhaust ducts and forming throttling points for the emerging cooling air.

3. The cylinder head of claim 2 including means for varying the cross-sectional area of each of said lateral outlets and thus the amount of cooling air allowed therethrough, the operational positioning of said area-varying means being based on the temperature of the emerging cooling air.

4. The cylinder head of claim 1 which further includes rocker arms, rocker arm bearing blocks, bolts for mounting the blocks, wherein said top air-leading surface is secured to the cylinder head together with said rocker arm blocks by said bolts, said top air-leading surface having a recess in the region of said valve guides and rocker arms so as to form, together a cover and a gasket, a tightly closed rocker box.

5. The cylinder head of claim 1 wherein said intake and exhaust ducts are each provided with a number of cooling fins therearound in the region where cooling air passes thereover.

* * * * *